US007231875B2

(12) United States Patent
Rastegar

(10) Patent No.: US 7,231,875 B2
(45) **Date of Patent: *Jun. 19, 2007**

(54) DEPLOYABLE BULLETS HAVING A TRANQUILIZER

(75) Inventor: Jahangir S. Rastegar, Stony Brook, NY (US)

(73) Assignee: Omnitek Partners LLC, Bayshore, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/290,948

(22) Filed: Nov. 30, 2005

(65) Prior Publication Data

US 2007/0101892 A1 May 10, 2007

Related U.S. Application Data

(62) Division of application No. 10/236,063, filed on Sep. 4, 2002, now Pat. No. 6,997,110.

(60) Provisional application No. 60/317,308, filed on Sep. 5, 2001.

(51) Int. Cl.
*F42B 12/46* (2006.01)
*F42B 10/02* (2006.01)
*F42B 30/02* (2006.01)

(52) U.S. Cl. ..... 102/502; 102/400

(58) Field of Classification Search ..... 102/502, 102/400; 89/1.11; 604/130
See application file for complete search history.

(56) References Cited

U.S. PATENT DOCUMENTS

| | | | | | |
|---|---|---|---|---|---|
| 3,502,025 | A * | 3/1970 | Payne | 102/512 |
| 3,782,286 | A * | 1/1974 | Jones et al. | 102/502 |
| 3,834,311 | A * | 9/1974 | Mawhinney et al. | 102/444 |
| 3,901,158 | A * | 8/1975 | Ferb | 102/512 |
| 3,952,662 | A * | 4/1976 | Greenlees | 102/400 |
| 4,008,667 | A * | 2/1977 | Look | 102/502 |
| 4,030,421 | A * | 6/1977 | Litman | 102/515 |
| 4,038,902 | A * | 8/1977 | Welsh | 89/1.807 |
| 4,104,974 | A * | 8/1978 | Robinett | 109/2 |
| 4,735,612 | A * | 4/1988 | Chevalier | 604/130 |
| 4,863,428 | A * | 9/1989 | Chevalier | 604/130 |
| 5,009,164 | A * | 4/1991 | Grinberg | 102/502 |
| 5,054,400 | A * | 10/1991 | Pineau et al. | 102/489 |
| 5,698,815 | A * | 12/1997 | Ragner | 102/502 |
| 5,750,918 | A * | 5/1998 | Mangolds et al. | 102/502 |
| 5,831,199 | A * | 11/1998 | McNulty et al. | 89/1.11 |
| 5,988,036 | A * | 11/1999 | Mangolds et al. | 86/1.1 |
| 6,605,059 | B1 * | 8/2003 | Middleton | 604/130 |
| 2005/0039628 | A1 * | 2/2005 | Carman | 102/502 |
| 2005/0044768 | A1 * | 3/2005 | Edwards | 42/1.08 |
| 2005/0188887 | A1 * | 9/2005 | Chang | 102/502 |

* cited by examiner

*Primary Examiner*—Troy Chambers

(57) ABSTRACT

A method for non-lethal crowd and personal protection. The method includes: firing non-lethal bullets towards a person; and deploying portions on the non-lethal bullets prior to impacting the person to decrease its impact pressure on the person.

2 Claims, 4 Drawing Sheets

DEPLOYABLE BULLETS HAVING A TRANQUILIZER

CROSS-REFERENCE TO RELATED APPLICATION

This application is a divisional of United States application Ser. No. 10/236,063 filed on Sep. 4, 2002 now U.S. Pat. No. 6,997,110, which claims priority to earlier filed United States provisional application Ser. No. 60/317,308 filed on Sep. 5, 2001, the entire contents of each of which is incorporated herein by its reference.

BACKGROUND OF THE INVENTION

1. Field of the Invention

The present invention relates generally to bullets, and more particularly, to bullets, which have deployable blades or other portions thereof to increase the footprint of the bullet and/or decrease the momentum of the bullet.

2. Prior Art

The first less-than-lethal bullets appeared in the 1880s when Singapore police shot sawed-off broom handles at rioters. By the 1960s, riot control police in Singapore, Malaysia, and Hong Kong were using more sophisticated wooden bullets. British colonists brought the idea back home to England, where they replaced the wood—which could shatter and possibly penetrate—with rubber. By the 1980s the British had switched to more accurate plastic bullets, solid polyvinyl chloride cylinders about 4 inches long and 1½ inches wide. The bullets are supposed to be shot at the lower half of the body. In the late 1980s, the Israeli military developed its own rubber bullets designed to disperse crowds, to injure but not kill. These small rubber-coated metal pellets are supposed to be shot from a distance of about 130 feet and aimed at people's legs. Rubber bullets were introduced in the United States to quell anti-war and civil rights demonstrators in the 1960s. Though famously deployed against recent protesters, they are most often used by individual police officers to subdue armed and mentally ill people. Rubber type bullets are also used in delicate environments, such as on aircraft, where a regular bullet may compromise the pressurized environment inside the aircraft cabin. The most common kinds are the bean-bag bullet, a cloth pouch with about 40 grams of lead shot that delivers the equivalent of a punch from a heavyweight boxer, and a plastic cylinder like that used in Northern Ireland.

Personal security for law enforcement officers using non-lethal force has been carried over into the public sector. As a result several new tools, in addition to rubber bullets, have been developed. These include stun guns and batons, air tasers, and pepper spray.

Stun guns and batons are devices that use high voltage to paralyze the target. This is accomplished by touching the device to the target. Air tasers are a variation on this by firing two small probes up to a range of 15 feet to deliver the paralyzing voltage. While pepper spray, as the name implies, uses a highly concentrated spray of pepper, up to 3 feet, to be fired into the targets eyes to temporarily blind the target.

There are significant flaws in the designs of all these types of personal security tools. Modern day rubber bullets still kill to often and are only effective if they target and impact a person's torso or leg area. If they impact a person's head, they can do considerable damage and even cause death, which is not generally the intent in situations that call for the use of rubber bullets. The stun guns and batons must be used at point blank range and are useless unless full contact is made. Common clothing, such as leather jackets, can provide adequate shielding. Air tasers are limited to 15 feet and can only be fired once. As with the stun gun/baton version both probes must penetrate the skin of the target to be effective. Pepper spray is limited to 3 feet and must be sprayed into the target's eyes or will back wash into the shooter eyes.

SUMMARY OF THE INVENTION

An objective of the present invention is to provide novel bullets that have deployable blades or other portions thereof to increase the footprint of the bullet and/or decrease the momentum of the bullet.

The bullets of the present invention are particularly suited for crowd control systems for law enforcement, as non-lethal weapons for law enforcement and military, and as a much more effective and safer replacement for tranquilizer darts used on animals. Although, the methods and devices of the present invention are applicable to bullets, darts, and other gun-fired projectiles, the same will be collectively referred to herein as bullets. These applications are generally much more effective than the systems that they are designed to replace while being also considerably safer. As a preferred implementation, one version of the proposed concept replaces currently used rubber bullets for being significantly safer and more effective.

Accordingly, a method for non-lethal crowd and personal protection is provided. The method comprising: firing non-lethal bullets towards a person; and deploying portions on the non-lethal bullets prior to impacting the person to decrease its impact pressure on the person.

Preferably, the method further comprises releasing a tranquilizer to the person, which is exposed by the deployment of the portions.

Alternatively, the method further comprises delivering high voltage to the person by electrodes which are exposed by the deployment of the portions.

In another alternative, the method further comprises releasing a fluid from at least a portion of the bullets, which is exposed by the deployment of the projections, the fluid at least temporarily immobilizing the person. The fluid is preferably selected from a group consisting of a tranquilizer and pepper spray.

Also provided is a method for non-lethal crowd and personal protection where the method comprises: firing non-lethal bullets towards a person; and releasing a fluid from at least a portion of the bullets, the fluid at least temporarily immobilizing the crowd or person.

Still further provided is a bullet comprising: a shell; deployable portions housed in or integral with the shell; and means for deploying the portions prior to impacting the person to increase the footprint of the projectile.

The deploying means preferably deploys air blades where the air blades preferably windmill the projectile.

Preferably, the means for deploying the portions comprises hinges disposed on the portions that at least partially deploy the portions due to the spinning of the projectile.

The bullet preferably further comprises means for releasing a tranquilizer that is exposed by the deployment of the portions.

Alternatively, the bullet further comprises means for delivering high voltage by electrodes that are exposed by the deployment of the portions.

In yet another alternative, the bullet further comprises means for releasing a pepper spray, which is exposed by the deployment of the portions.

Preferably, the bullet comprises front and rear sections separable from each other, where at least one of the front or rear sections contains the deployable portions. Preferably, each of the front and rear sections have a set of deployable portions.

Still further yet provided is a bullet comprising: a shell; a fluid disposed in at least a portion of the shell, the fluid being used to at least partially immobilize a person; and means for releasing the fluid to the person. The fluid is preferably selected from a group consisting of a tranquilizer and pepper spray.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

Figure 1C:
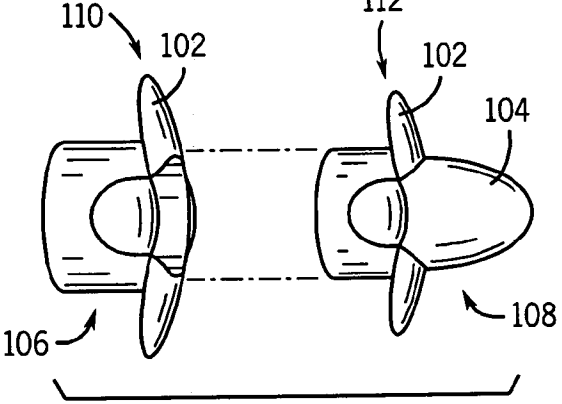
FIGS. 1A–1C illustrate schematic views of a first preferred implementation of a bullet having deployable blades.

In operation, a bullet of the present invention is fired from a small or medium caliber gun barrel. The bullet is generally constructed with deployable blades or other deployable portions which act to reduce the momentum of the bullet. As discussed below, the blades or other deployable portion of the bullet can be spring loaded and deployed after exiting the gun barrel. Preferably, the blades or other deployable portion of the bullet are deployed, at least partially, by the centrifugal force on the deployable portion due to the spinning of the bullet when it exits the gun barrel. In both preferred implementations, as discussed below, the blades or other deployable portion can have a weakened portion acting as a living hinge to aid in the deployment of the blades or other deployable portion. Furthermore, due to the airflow around the bullet, once the blades or other deployable portion begins to deploy, the airflow against the same will also aid in their deployment.

At an optimal distance from the target, the blades are deployed to increase the effective cross-sectional area to equal the span of the propellers and thus slowing the bullet due to the increased surface area and resulting aerodynamic drag. The blades can optionally windmill, creating drag and slowing the bullet further while increasing the spinning rate of the projectile.

To describe the windmilling concept in more detail, the windmill should be aft of the center of gravity of the bullet for longitudinal stability, i.e., the windmill should pull the bullet backwards to thus, reduce its velocity and hence its momentum.

A simple mathematical model of the interceptor after deployment involves two forms of Newton's second law, one for the linear motion and the other for the angular motion.

$$m\frac{dVi}{dt} = -D(V, \alpha) \tag{1}$$

$$I\dot{\alpha} = \epsilon D(V, \alpha) r_0 \tag{2}$$

where D is drag due to transferal of linear momentum to torque, which is a quadratic function of the velocities, and will decelerate the bullet, and $\alpha$ is a drag parameter.

This drag will then provide a positive torque, with efficiency $\epsilon$ and radial length $r_0$ that will spin up the bullet. Some design parameters are: The initial spin rate of the interceptor; The number of blades and possibility of more than one layer of blades; The initial velocity of the bullet; blade deployment time; The pitch of the blades may also be varied for optimal action.

The bullets of the present invention are particularly well suited for non-lethal weapon applications, such as those for crowd control and for personal protection, especially, if a windmilling configuration is used. For example, such deployable windmilling or whirlybird type interceptors are preferably made out of relatively soft, rubber or rubber like materials, and can be used instead of rubber bullets. In which case, the significantly larger cross-sectional area would significantly decrease the impact pressure over the body but not the transferred momentum. As the result, the possibility of localized injury is significantly decreased, while maintaining the impact force to stun, which is the desired result. The blades are preferably configured not to cut because they are preferably made out of relatively resilient material and that, for example, being swept somewhat backwards and formed to readily bend to minimize the possibility of digging in at the point of impact.

The typical scenario is that distances are a maximum of 100 meters and that the targets are slow moving so that a relatively low speed bullet can be used. A rifled bullet in which propellers are deployed right after launch is also feasible and would allow the introduction of more rapid rate firing mechanisms.

Figure 1B:
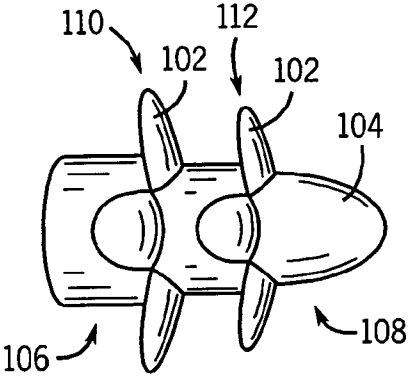
Figure 1A:
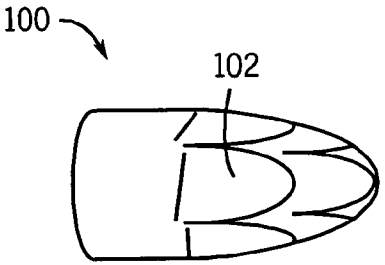

As examples of non-lethal applications, the following four deploying bullet concepts are provided. Although, described in terms of deploying "blades" those skilled in the art will appreciate that any portions of the bullet can deploy without departing from the scope or spirit of the present invention. The primary concept for a non-lethal deployable bullet is shown in FIGS. 1A–1C. The bullet 100 is shown in FIG. 1A when it first exits a gun barrel from which it is fired. The bullet 100 is considered to be fired from a conventional gun barrel and contains a charge for firing, as do conventional bullets. The bullet is assumed to spin due to the rifling action of the gun barrel. The bullet has at least two and preferably a plurality of deployable blades 102. After exiting the gun barrel, the blades 102 begin to deploy as will be described below. The deployment of the blades 102 can expose any shape of leading edge 104 of the bullet, such as a circular, elliptical, concave, or a flat shape. The bullet 100 can also be hollow inside the deployable blades 102. However, it is preferred that the leading edge 104 exposed by the blades 102 mimics the leading edge shape of a corresponding conventional bullet to promote stability in the flight of the bullet 100. The bullet 100 can continue its flight to the intended target in the configuration shown in FIG. 1B. However, it is preferred that the bullet separate into back and front slug sections 106, 108. The front slug section 108 preferably maintains the bullet nose or leading edge 104, while the back slug section will maintain the rear of the bullet. The front section 108 due to the drag on the blades move an appropriate distance forward to allow the nose to impact the target first. The back section 106 impacts the target very soon after the front section 108 to prevent load to be concentrated at one location or to distribute the impact over a greater time. As illustrated in FIG. 1C, it is preferred that at least two layers of blades 110, 112 are deployed, one of which 110 remains with the back portion 106 and the other of which 112 remains with the front section 108. In this way, both portions 106, 108 are slowed due to the deployed blades 102.

Figure 2A:
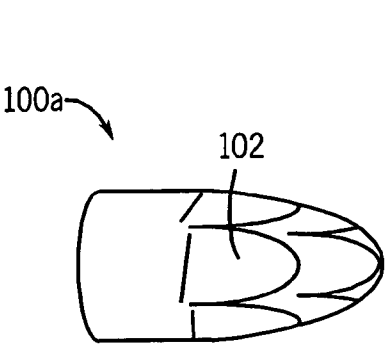
FIGS. 2A–2C illustrate schematic views of an alternative second implementation of the bullet of FIGS. 1A–1C.
Figure 2B:
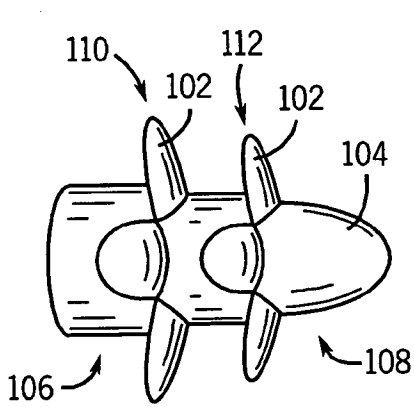
Figure 2C:
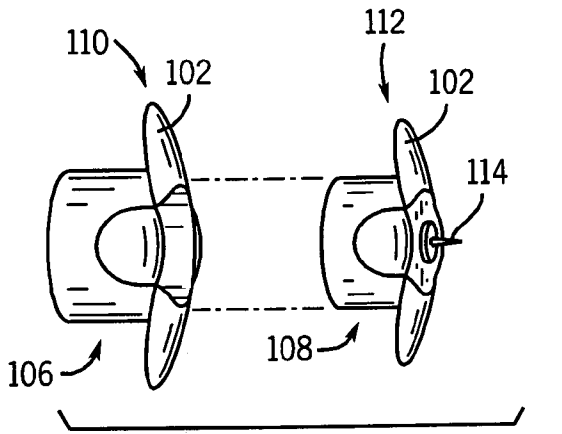

FIGS. 2A–2C illustrate the schematics of a variation of the first implementation of FIGS. 1A–1C. This variation includes a bullet 100*a* which has the front section 108 opening up to expose a tranquilizer dart 114. The tranquilizer is contained within a cavity (not shown) in the front section 108 and is delivered from the cavity through a lumen in the tranquilizer dart 114 upon impact with the target. No pumping means is necessary because the impact and sudden deceleration of the bullet will cause the liquid tranquilizer to continue its momentum through the lumen and into the target. The back section 106 remains a slug to provide extra needle insertion and injection force. The blades 102 are preferably positioned longitudinally to limit the maximum tranquilizer force and maximum penetration level. Although the first and second blade sets 110, 112 are shown deploying at the same time to expose tranquilizing needle 114, the second set of blades 112 can deploy at a later time than the first set of blades 112. A similar configuration can also be used in any of the other implementations disclosed herein, including the first implementation discussed with regard to FIGS. 1A–1C.

Figure 3C:
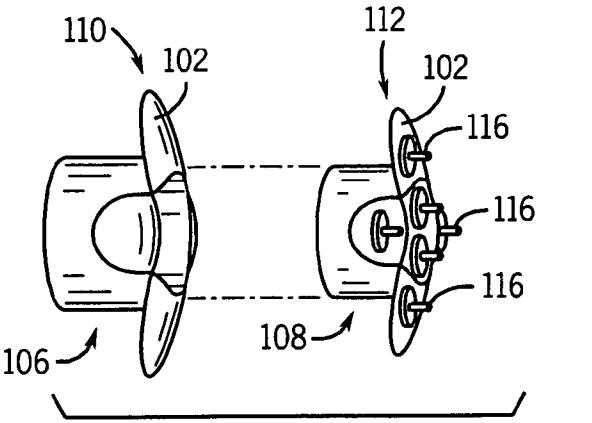
FIGS. 3A–3C illustrate schematic views of an alternative third implementation of the bullet of FIGS. 1A–1C.
Figure 3B:
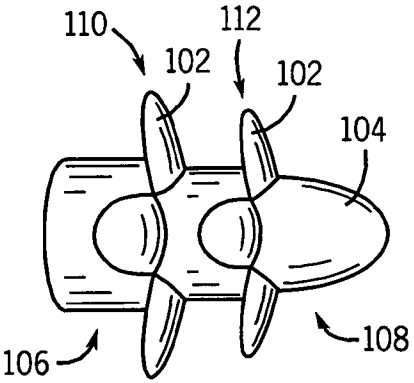
Figure 3A:
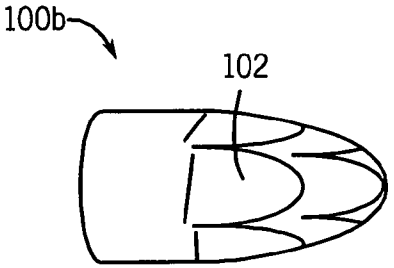

FIGS. 3A–3C illustrate a second alternative implementation of the bullets of FIGS. 1A–1C. This alternative implementation is similar to that discussed with regard to FIGS. 2A–2*c*, except that the bullet 100*b* has a front section 108 which opens up to expose electrodes 116. These electrodes 116 are configured to deliver a high voltage to temporarily paralyze the target. The electrodes are supplied with the high voltage from a power cell (not shown) contained within a cavity of the front section 108. The currently available electrode devices need to be aimed very accurately to hit the target and can fire only one shot. More than one of the bullets 100*b* of FIGS. 3A–3C can be loaded into a firing gun and it would be much more difficult to miss the target, particularly by a terrified user. Furthermore, current electrode devices are often made useless by thick clothing worn by the target. The bullets 100*b* would be more effective against clothing because of the greater momentum of the bullets. Although, FIG. 3C illustrates a plurality of electrodes 116, one or more can also be used without departing from the scope or spirit of the present invention.

Figure 4C:
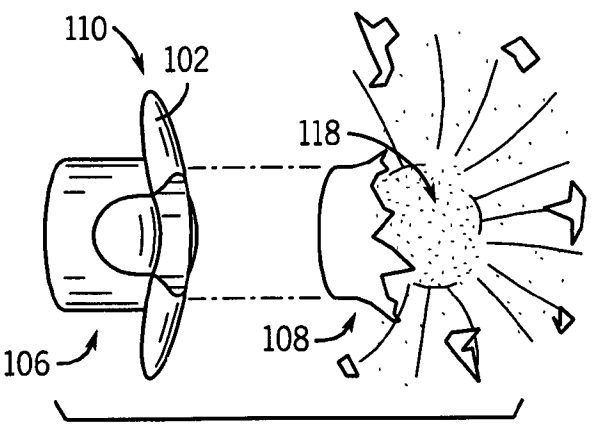
FIGS. 4A–4C illustrate schematic views of an alternative fourth implementation of the bullet of FIGS. 1A–1C.
Figure 4B:
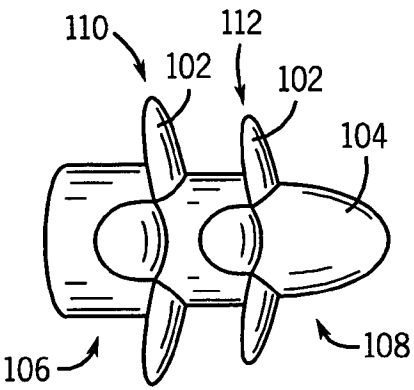
Figure 4A:
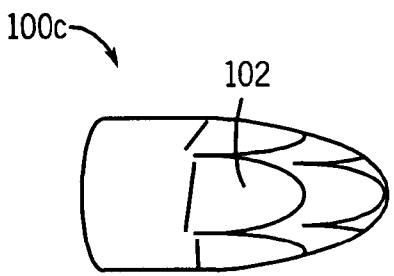

FIGS. 4A–4C illustrate a third alternative implementation of the bullet of FIGS. 1A–1C. The bullet 100*c* of the third alternative variation is similar to that of the first and second alternative implementations discussed with regard to FIGS. 2A–2C and 3A–3C except that the front section 108 opens up to release a pepper spray 118 or other gas or liquid which can be used to immobilize the target. The pepper spray 118 is currently used to temporarily blind the targets. The pepper spray 118 material is contained within the front section 108 which is preferably breakable upon impact with the target. To facilitate the breaking of the front portion 108 to release the pepper spray 118, the leading edge 104 is made of a thin brittle material, such as glass. Alternatively, the front section 108 can explode with a timed explosive (timed from the time of firing) to expose the pepper spray 118 at a predetermined distance in front of the target. The bullet 100*c* can be fired from a much farther distance than a spray can and safely away from the user, and would also give a jolt (impact) to the target subject.

Although the bullets which deliver tranquilizer and pepper spray (or other fluids which tend to immobilize the target person) bullets are shown and described with regard to the deployable portions, those skilled in the art will appreciate that such fluids can be delivered without such deployable portions, such as with a bullet having the fluid in an internal cavity which is broken by impact or timed for breaking before impact. For example, the bullet can have a thin glass tip which contains the fluid and which is broken by the impact of the tip onto the target person.

A less lethal, more effective, and more versatile method of personal security, is provided by the deployable bullets 100, 110*a*, 110*b*, and 100*c* of the present invention. An expanding bullet allows several variations. A simple expandable slug reduces blunt trauma but not impact. Combined with a tranquilizer, paralyzing voltage, and/or pepper spray increases the amount of protection provided currently. This will also give great range options from point blank to a several dozen yards.

Figure 5A:
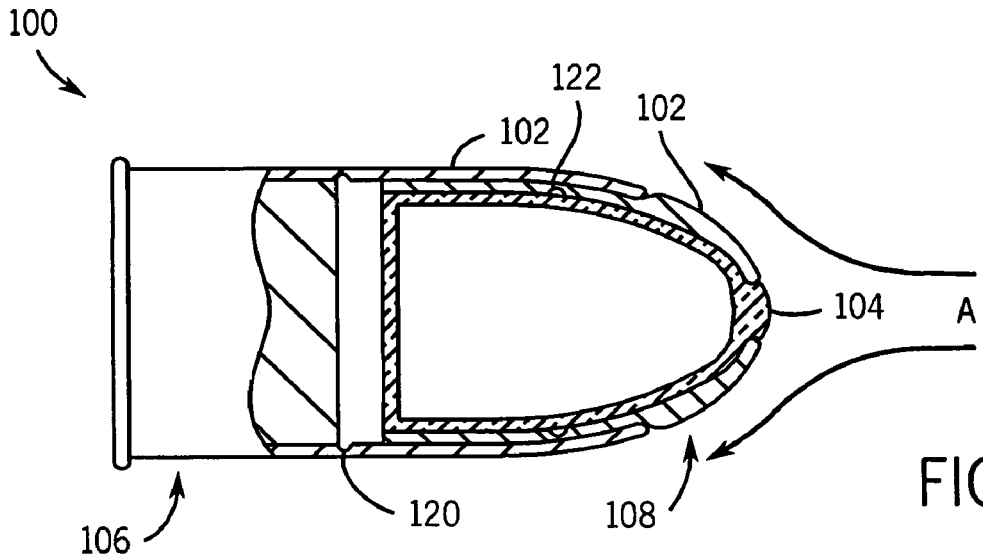
FIGS. 5A–5C illustrate partial sectional views of a bullet of the present invention according to a preferred implementation for deploying the blades thereof.
Figure 5B:
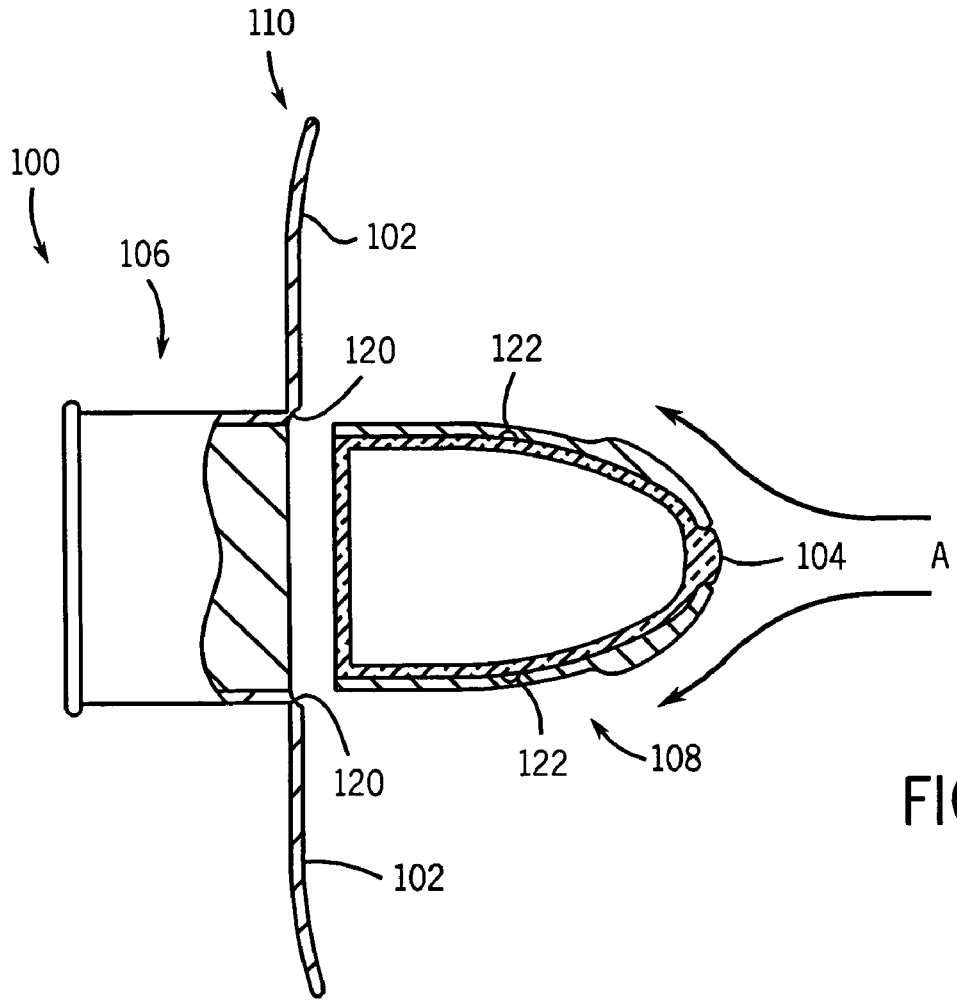
Figure 5C:
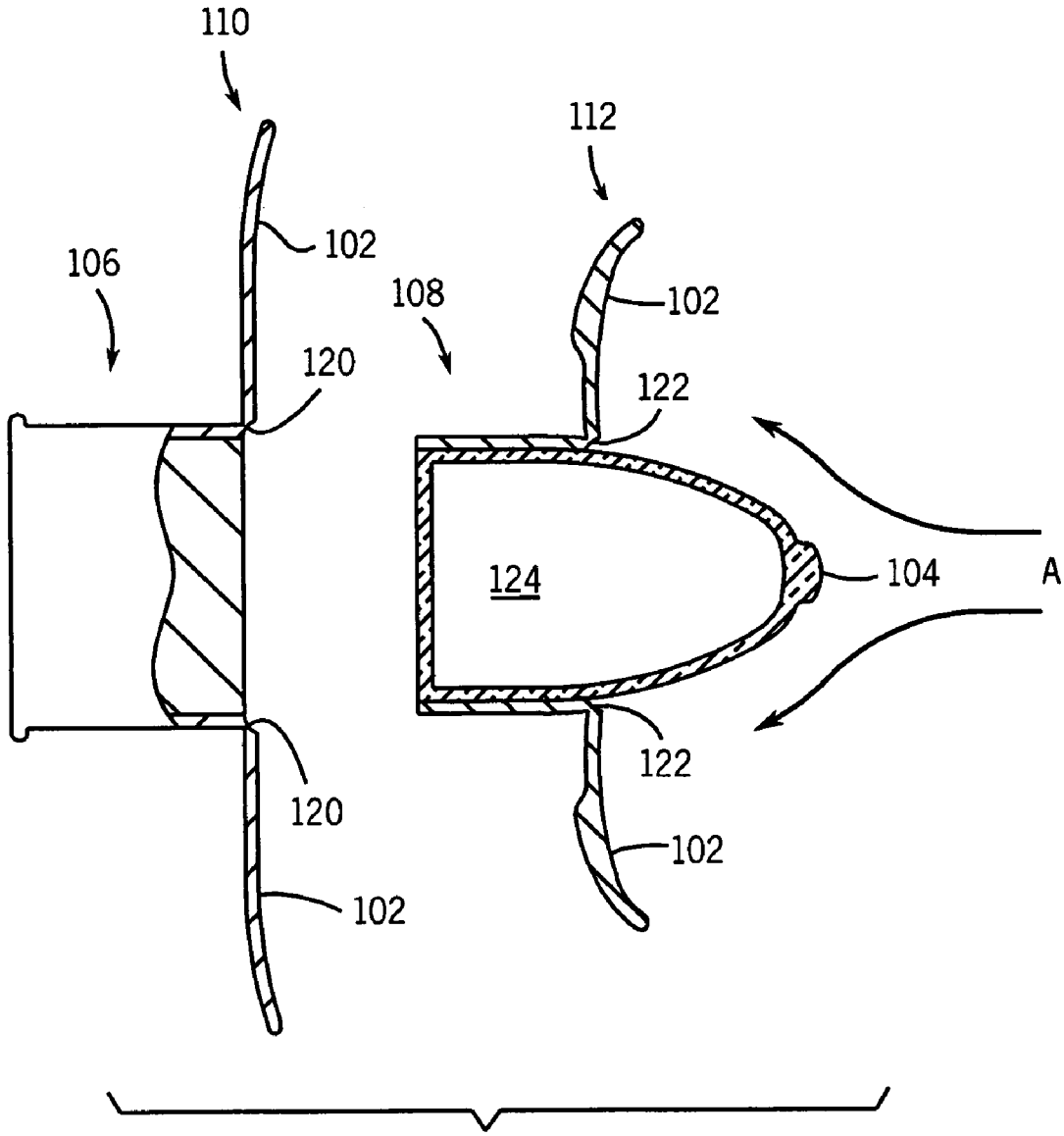

Referring now to FIGS. 5A–5C, a preferred implementation for deploying the blades 102 of the bullets 100, 100*a*, 100*b*, and 100*c* are shown. A purely mechanical means for deploying the blades is shown and preferred, however, those skilled in the art will appreciate that other means are possible. FIG. 5A shows a partial sectional view of a bullet 100 having deployable blades 102 in first and second layers 110, 112 disposed on back and front sections 106, 108, respectively. Similar configurations are possible for the bullets 100*a*, 100*b*, and 100*c* shown in FIGS. 2A–2C, 3A–3C, and 4A–4C, respectively. Preferably, as shown in FIG. 5A, the blades 102 are contoured to fit over each other to provide a smooth outer surface of the bullet 100. Further, the first set of blades 110 overlap the second set of blades 112 and prevent the second set of blades 112 from deploying until the first set of blades 110 are deployed.

After the bullet 100 is fired from the gun barrel, the first set of blades 110 on the back section 106 deploy. Preferably, the blades 102 deploy about a hinge or pivot 120 which is preferably a living hinge fabricated into the blade material. The living hinge is preferably a weakened or thin cross-section portion of the blade 102. The blades 102 preferably deploy due to a centrifigal force on the blades 102 due to the spinning of the bullet 100. Alternatively, the blades 102 can be positively biased outward by a spring material, which is either separately added to each blade 102 or integrally formed therein. In such a configuration, the blades 102 are retained in the bullet shape by the bore of the gun barrel and deploy after the bullet 100 exits the gun barrel by the biasing effect of the springs. In either configuration, once the blades 102 begin to deploy, the air flow A around the bullet 100 aids in further deploying the blades 102 due to the air drag on the blades 102.

FIG. 5B shows the first set of blades 110 fully deployed. A stop (not shown) may be provided to prevent the blades from folding backwards onto the body of the bullet. After the first set of blades 110 are deployed, the front portion 108 of the bullet 100 is free from the back portion 106 and the second set of blades 112 are no longer restrained from deploying by the first set of blades 110. Because of the deployment of the first set of blades 110, the back section 106 of the bullet slows down, due to the increased drag on the back section 106 caused by the deployment of the first set of blades 110 and/or a windmilling effect of the first set of blades 110. The second set of blades 112 then deploy in a manner described above, i.e., about a living hinge 122 due to a centrifugal force on the blades 102. FIG. 5C shows the bullet 100 in which the back and front sections 106, 108 are separated and their respective first and second sets of blades 110, 112, are deployed. In the implementations of FIGS. 2A–2C, 3A–3C, and 4A–4C, the tranquilizer, power cell, and pepper spray can be disposed in cavity 124.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A method for non-lethal crowd and personal protection, the method comprising:

firing one or more non-lethal bullets towards a person;

deploying portions on the one or more non-lethal bullets prior to impacting the person to decrease its impact pressure on the person; and releasing a tranquilizer to the person, which is exposed by the deployment of the portions.

2. A bullet comprising:

a shell;

deployable portions housed in or integral with the shell;

means for deploying the portions prior to impacting the person to increase the footprint of the bullet; and means for releasing a tranquilizer that is exposed by the deployment of the portions.

* * * * *